US008567328B2

(12) United States Patent
Guerreschi

(10) Patent No.: US 8,567,328 B2
(45) Date of Patent: Oct. 29, 2013

(54) CONVEYING DEVICE AND SEWING MACHINE COMPRISING SAID DEVICE

(75) Inventor: Carlo Guerreschi, Verona (IT)

(73) Assignee: VI.BE.MAC. S.p.A., Verona (IT)

( * ) Notice: Subject to any disclaimer, the term of this patent is extended or adjusted under 35 U.S.C. 154(b) by 486 days.

(21) Appl. No.: 12/941,309

(22) Filed: Nov. 8, 2010

(65) Prior Publication Data

US 2011/0114001 A1 May 19, 2011

(30) Foreign Application Priority Data

Nov. 19, 2009 (IT) ..... VR2009A0195

(51) Int. Cl.
*D05B 27/00* (2006.01)

(52) U.S. Cl.
USPC ..... 112/304

(58) Field of Classification Search
USPC ..... 112/304, 305, 306, 470.05, 470.06, 112/470.09, 470.18, 475.07
See application file for complete search history.

(56) References Cited

U.S. PATENT DOCUMENTS

| | | | | |
|---|---|---|---|---|
| 3,232,256 A | | 2/1966 | Buckalter | |
| 3,469,545 A | | 9/1969 | Hale | |
| 3,583,341 A | * | 6/1971 | Birdsong et al. | 112/470.36 |
| 3,861,338 A | * | 1/1975 | Galya et al. | 112/104 |
| 4,044,698 A | * | 8/1977 | Conner, Jr. | 112/470.07 |
| 4,327,653 A | * | 5/1982 | Blessing | 112/470.12 |
| 4,483,262 A | | 11/1984 | Keeton | |
| 4,483,266 A | * | 11/1984 | Olasz et al. | 112/304 |
| 4,800,830 A | * | 1/1989 | Adamski et al. | 112/303 |

FOREIGN PATENT DOCUMENTS

| | | |
|---|---|---|
| EP | 0562383 A2 | 9/1993 |
| JP | 3223032 A | 8/1995 |

OTHER PUBLICATIONS

Italian Search Report of Application No. IT VR20090195.
European Search Report of Application No. EP 10014746.

* cited by examiner

*Primary Examiner* — Tejash Patel
(74) *Attorney, Agent, or Firm* — Notaro, Michalos & Zaccaria P.C.

(57) ABSTRACT

Conveying device to be mounted on a sewing machine comprising a plate to be constrained to a base of the sewing machine, a conveyor belt mounted on two rollers constrained to a supporting structure so as to rotate, the supporting structure being coupled with the sewing machine, so that the conveyor belt is adjacent to the plate, and motor means connected with the conveyor belt and suited to put said belt in motion so that a cloth arranged between the plate and the conveyor belt translates when the conveyor belt is put in motion. The conveying device comprises at least a pressing element actuated by a piston of a cylinder which comprises elastic means and is constrained to the supporting structure of the conveyor belt, said cylinder being connected with a pressure control system. The pressure control system adjusts the pressure acting on the cloth to be conveyed since the elastic means are adjustable through the same system and the pressing element is in contact with the portion of the plate and/or belt.

16 Claims, 15 Drawing Sheets

CONVEYING DEVICE AND SEWING MACHINE COMPRISING SAID DEVICE

The present invention refers, in general, to a conveying device and to a sewing machine comprising said device. More particularly, the present invention refers to a conveying device and to a sewing machine comprising said device, said device conveying the cloth to be sewn from a loading position to a sewing position and then, to an unloading position.

As is known, the sewing machines that operate a mechanical sewing, in an industrial level, of two or more articles of clothing are usually conceived according to different constructive techniques depending on the various operations to be effected.

For instance, the one-needle units and the more-needle units are known. These units are to sew articles of clothing such as trouser jeans or casual trousers in general, work garments and shirts or the like.

In their conventional form, said versions are provided with an upper head on which the needle is positioned, a conveying device conveying the articles of clothing to be sewn and a base which is positioned under the upper head and comprises means which cooperate with the needle for the formation of the sewing stitch.

The conveying device according to the prior art usually comprises a conveyor belt which is moved suitably by driving means, the conveyor belt being positioned next to the upper flat surface of the base. During the utilization of the sewing machine, the user has just to arrange the cloth on the upper surface of the base and to approach same to the conveyor belt, instead of displacing the cloth manually. Thus, the cloth is arranged between the base and the belt, is advanced continuously by the conveyor belt from a loading position to a sewing position and then, to an unloading position.

According to the prior art, the conveying device comprises two conveyor belts, arranged parallel to each other, so that the cloth translates without incurring unwished rotations.

In order that the conveying device might feed the cloth in a suitable way, the one or more conveyor belts must press the cloth itself against the base. Besides, as the thickness of the cloth to be sewn is variable, the distance between conveyor belt and base is adjustable.

According to the prior art, the aforesaid requirements are satisfied as the portion of conveyor belt next to the base is put under pressure by a spring system acting on the belt in order to vary the distance from the base and the pressure on the cloth.

Said spring system can not be adjusted to vary the pressure acting on the belt and therefore, for the control of the pressure it is necessary to replace the springs according to the wished value.

In addition, said system allows the conveyor belt to vary its position only in the vertical sense and therefore, the conveyor belt itself can adapt scarcely to the conformation and movement of the cloth.

Besides, the pressure applied on the belt and consequently on the cloth by the spring system is not constant but it varies according to the compression of the springs, which may provoke a damage of the cloth.

Accordingly, said conveying devices are not very safe and practical. Besides, in the conveying devices of the prior art, there could occur other drawbacks such as a moving away of the belt from the moving rollers or an insertion of cloth between the conveyor belt and the rollers.

An aim of the invention is to remove the aforesaid drawbacks and further ones by carrying out a conveying device which is easy and practical to be used.

A further aim of the invention is to carry out a conveying device in which the pressure on the cloth is adjustable in a simple, rapid way.

Another aim of the invention is to carry out a conveying device which puts the cloth under pressure in a constant way, regardless of the thickness and conformation of the cloth itself.

All the aforesaid aims and advantages are achieved according to the invention through a conveying device to be mounted on a sewing machine comprising a plate to be constrained to a base of the sewing machine, a conveyor belt mounted on two rollers constrained to a supporting structure so as to rotate, the supporting structure being coupled with the sewing machine, so that the conveyor belt is adjacent to the plate, and motor means connected with the conveyor belt and suited to put said belt in motion so that a cloth arranged between the plate and the conveyor belt translates when the conveyor belt is put in motion. The conveying device is characterized in that it comprises at least a pressing element actuated by a piston which slides in the inside of a cylinder which comprises elastic means acting on the piston and is constrained to the supporting structure of the conveyor belt. In addition, said cylinder is connected with a pressure control system and said pressing element is in touch with a sector of said plate and/or a sector of said belt so that the pressure control system regulates the pressure acting on the cloth to be conveyed.

The so-described device guarantees an optimal control of the pressure acting on the cloth, fed on the conveyor belt and arranged between the conveyor belt and the plate next to it; in fact, the conveyor belt or the plate or both press the conveyed cloth according to parameters which the user sets up through the pressure control system since the belt or the plate or both comprise one or more portions on which pressing means act, said pressing means being actuated by pressing devices.

Advantageously, in the conveying device according to the invention, the elastic means consist of a compressible fluid and a chamber is obtained in the cylinder in which the piston slides and the compressible fluid flows; the chamber is in communication with the pressure control system that regulates the flow of compressible fluid in the chamber. The pressure control system varies the quantity of fluid in the inside of the chamber and therefore, it varies the pressure which the pressing element applies on the portion of plate and/or belt.

Consequently, in case the fluid is air, the pressure control system is a is pneumatic plant and the cylinders for the regulation of the pressure are pneumatic cylinders. Obviously, different fluids are utilizable and the system could be an hydraulic system.

Besides, the elastic means may comprise a spring acting on the piston and means for the regulation of the extension of said spring; said means of regulation are connected with the pressure control system so that the pressure control system varies the extension of the spring and consequently, it varies the pressure which the pressing element applies on the portion of the plate and/or belt.

In the way, the pressure is regulated according to the adjustable extension of the springs; the pressure control system may regulate the pressure by means of suitable mechanical elements.

Advantageously, the pressing element, especially when acting on the belt, comprises at least one roller with pins, constrained to a carriage, actuated by the piston of the cylinder, so that the roller acts on the conveyor belt without hindering its movement.

In addition, the conveying device according to the invention comprises position limiting means, coupled with the supporting structure for the conveyor belt and connected with the at least one roller, so that the motion of the at least one roller is limited by said position limiting means. In this way, the piston actuated by the cylinder, fixed on the supporting structure for the conveyor belt, can put the roller in motion inside fixed positions.

Advantageously, the carriage comprises at least one roller the pins of which are pivoted in at least one lamella on which a plaque is fixed, the piston of the cylinder pressing said plaque. In this way, a carriage is obtained with one fork on which one or more rollers are fixed so as to rotate.

Besides, the position limiting means may comprise at least one side wall, fixed on the supporting structure of the conveyor belt and arranged parallel to the direction of action of the piston; at least one through-hole is obtained in said side wall and at least one pin and/or the plaque passes through said hole. The dimensions of the at least one through-hole are larger than the passing section of the pin and plaque so that the one or more rollers can shift in a limited space under the pressing action of the piston and conveyor belt. In this way, the position of the carriage and the position of the one or more rollers are several but all of them are included in specific limits.

In particular, the carriage may comprise a first roller and a second roller and the pins of said rollers are pivoted on a first lamella on the one side and on a second lamella on the other side, said first lamella and said second lamella being fixed on each other by means of the plaque. In this way, it is possible to obtain a carriage with two rollers, connected to each other, on which an only piston acts.

With the so-described carriage, the position limiting means comprise a first side wall, fixed on a side of the supporting structure of the conveyor belt, and a second side wall, fixed on the opposite side of the supporting structure of the conveyor belt, said first side wall and said second side wall being arranged parallel to the direction of action of the piston and to the movement of the first roller and second roller. At least a first series of through-holes comprising a first hole, a second hole and a third hole is obtained in said first side wall and at least a second series of through-holes comprising a first hole, a second hole and a third hole is obtained in said second side wall, the at least a first series of holes and the at least a second series of holes being arranged so as to correspond with each other. The connection of the one or more carriages with the side walls is obtained in that the pins of the first roller pass through the first hole of the first series of holes and through the first hole of the second series of holes, the pins of the second roller pass through the second hole of the first series of holes and through the second hole of the second series of holes, and the plaque passes through the third hole of the first series of holes and the third hole of the second series of holes. The dimensions of the first hole, second hole and third hole of both the first series and the second series are larger than the passing section of the holes of the pins of the first roller, pins of the second roller and plaque, respectively. In this way, the first roller and the second roller can move under the action of the piston and in consequence of the pressure of the cloth on the belt, they move inside room limits, fixed by the dimensions of the through-holes.

Advantageously, in order to avoid that portions of the cloth to be fed are collected involuntarily and unintentionally between the rollers and the conveyor belt, the first lamella and the second lamella are coupled with the first pins, second pins and plaque out of the first side wall and second side wall while the first roller and second roller are positioned in the inside, between the first side wall and the second side wall. In this way, all the rollers are positioned in the inside, between the two side walls.

Advantageously, the carriages for the control of the pressure applied on the conveyor belt may be more than one and may be connected with each other in series and with the pressure control system in order to obtain a homogeneous, constant pressure on the cloth, along the whole advancing belt.

Besides, in the conveying device according to the invention, an end of the plate is put under pressure by at least one pressing element actuated by at least one piston of a cylinder; in this way, since said end of the plate corresponds to the entry for the cloth to be conveyed by the conveying device, the pressure on the cloth is controlled from the entry of the cloth in the device.

Advantageously, the end of the plate is divided by a cut into a first sector and a second sector, said first sector being subjected to the action of a first pressing element, actuated by a first piston of a first cylinder, said second sector being subjected to the action of a second pressing element, actuated by a second piston of a second cylinder. For a better control of the feeding and a parallel displacement of the cloth, a first conveyor belt acts on a cross sector of the plate that corresponds with said first sector, and corresponding pressing elements act on said first conveyor belt, and a second conveyor belt acts on a cross sector of the plate that corresponds with said second sector and corresponding pressing elements act on said second conveyor belt. All the above aims and advantages are reached according to the present invention through a sewing machine comprising the so-described conveying device.

Further features and details of the invention will be better understood from the following specification, given as a non-limiting example, as well as from the accompanying drawings, wherein.

Figure 2:
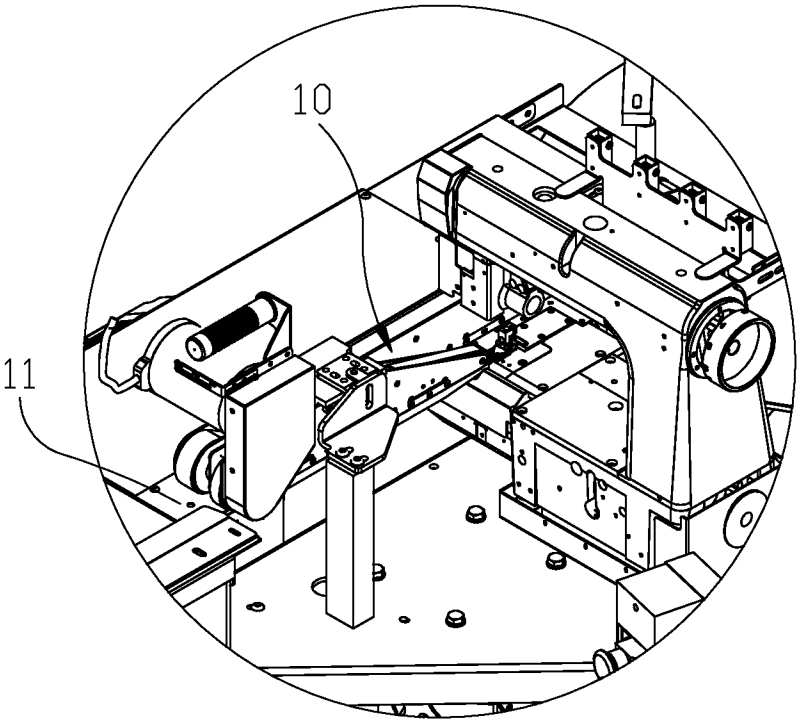
FIG. 2 shows a detail indicated with A in FIG. 1.
Figure 1:
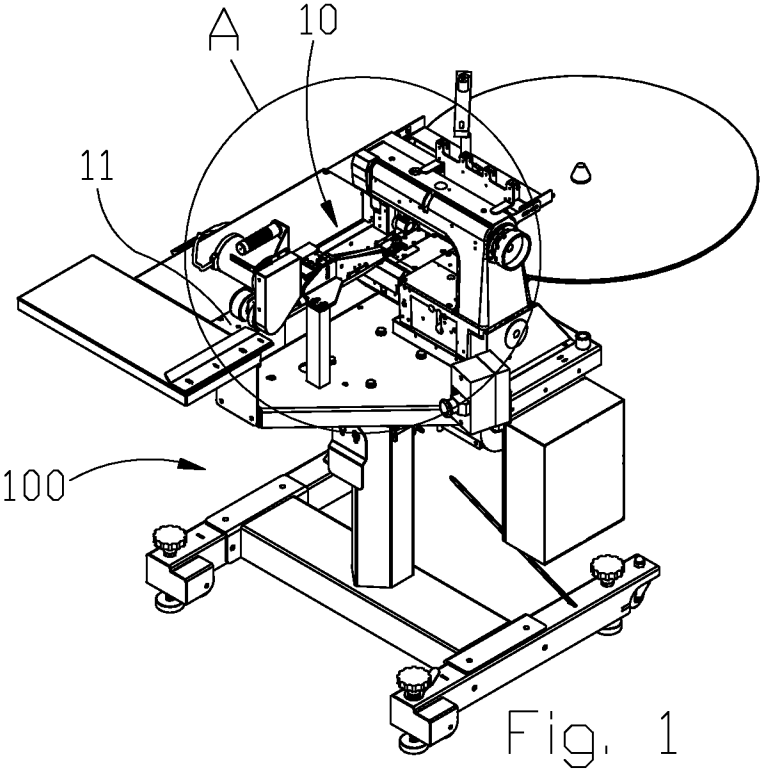
FIGS. 1, 3 are axonometric top views of a sewing machine comprising a conveying device according to the present invention.
Figure 4:
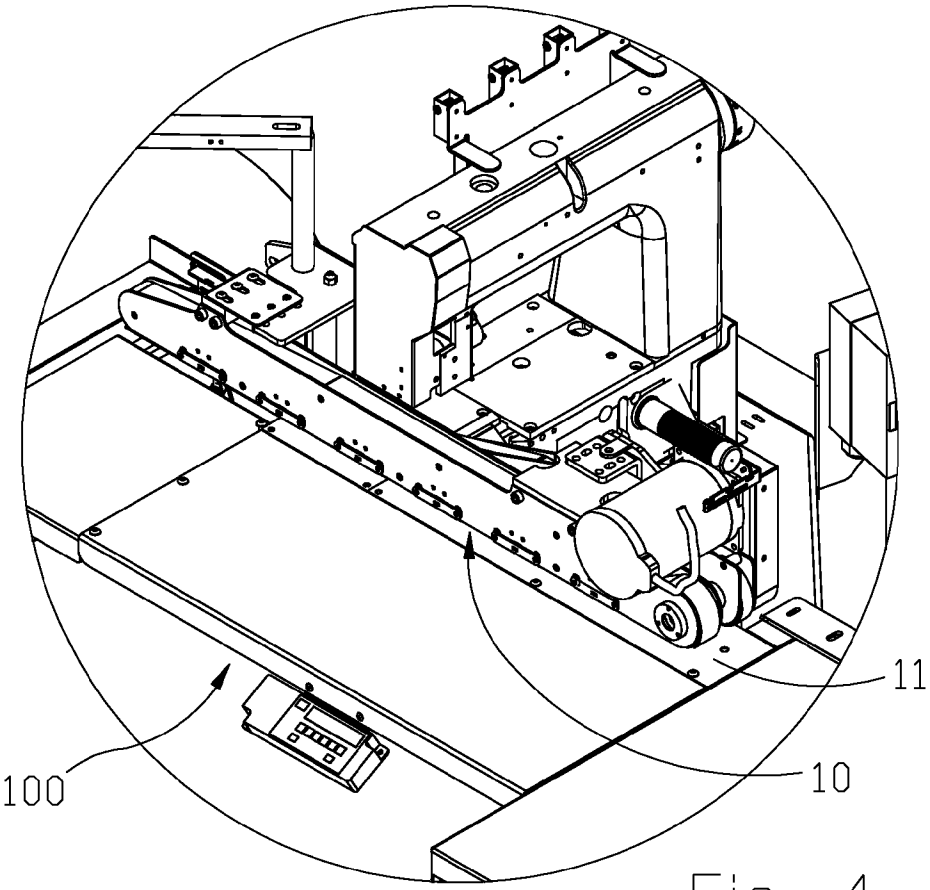
FIG. 4 shows a detail indicated with B in FIG. 3.
Figure 3:
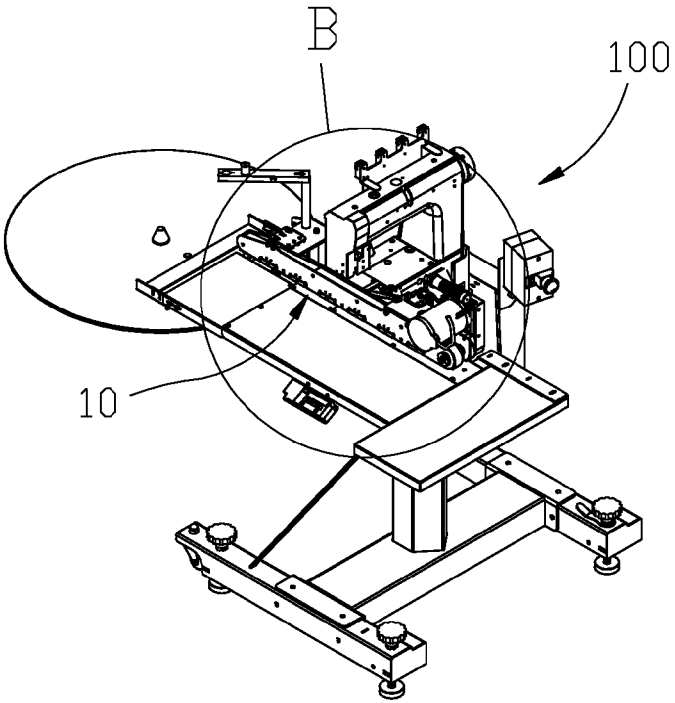

With reference to the accompanying drawings, in particular FIGS. 1 and 3, number 100 denotes a sewing machine comprising a head and a base, not represented in the Figures and produced according to the prior art, as well as a conveying device, indicated with reference number 10.

As it appears from FIGS. 1, 2, 3, 4, the conveying device 10 comprises a base support 11 which is constrained rigidly to the base of the sewing machine 100.

Figure 5:
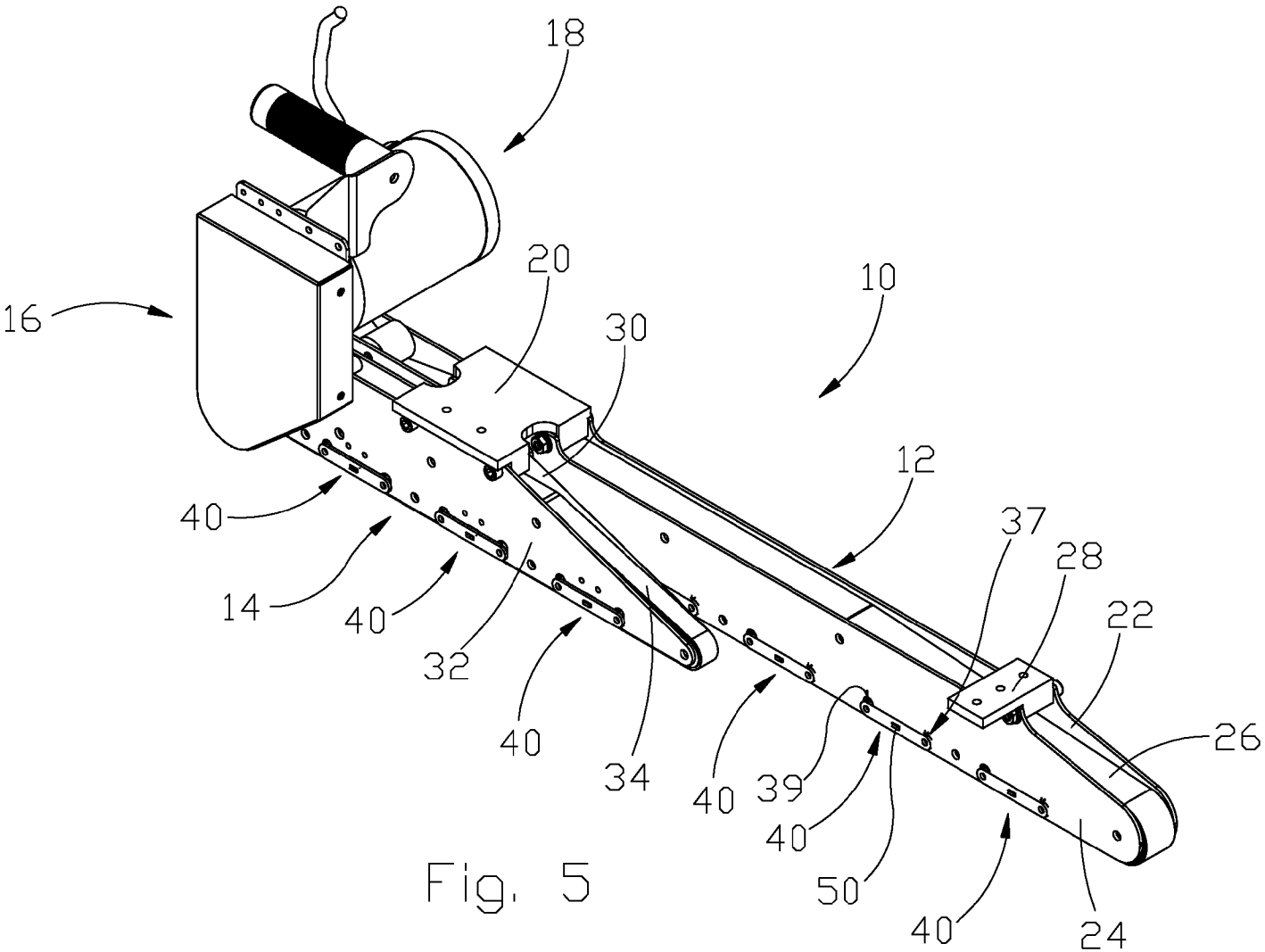
FIGS. 5, 6 are axonometric top views of the conveying device according to the present invention, comprising a first conveyor belt and a second conveyor is belt.
Figure 6:
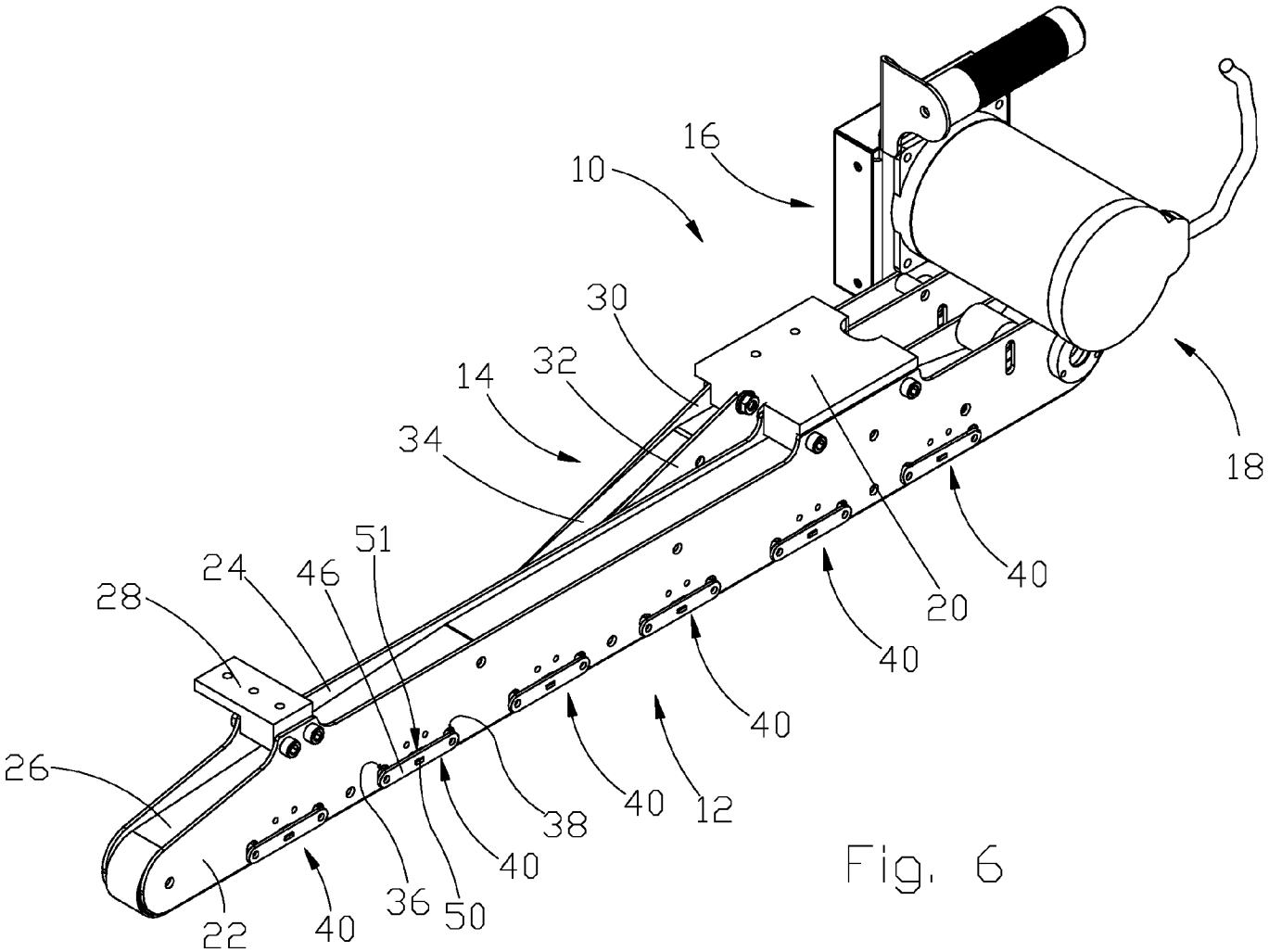

In addition, the conveying device 10 comprises a first conveying element 12 and a second conveying element 14, which are connected with each other through a plate 20 and are moved through a driving gear 16, actuated by motorization means 18, as it can be seen in FIGS. 5, 6. The driving gear 16 and the motorization means 18 are not described further since both are carried out according to the prior art.

The conveying device 10 is fixed on the sewing machine 100 through the plate 20 and a connector 28, fixed on the first conveying element 12.

Figure 7:
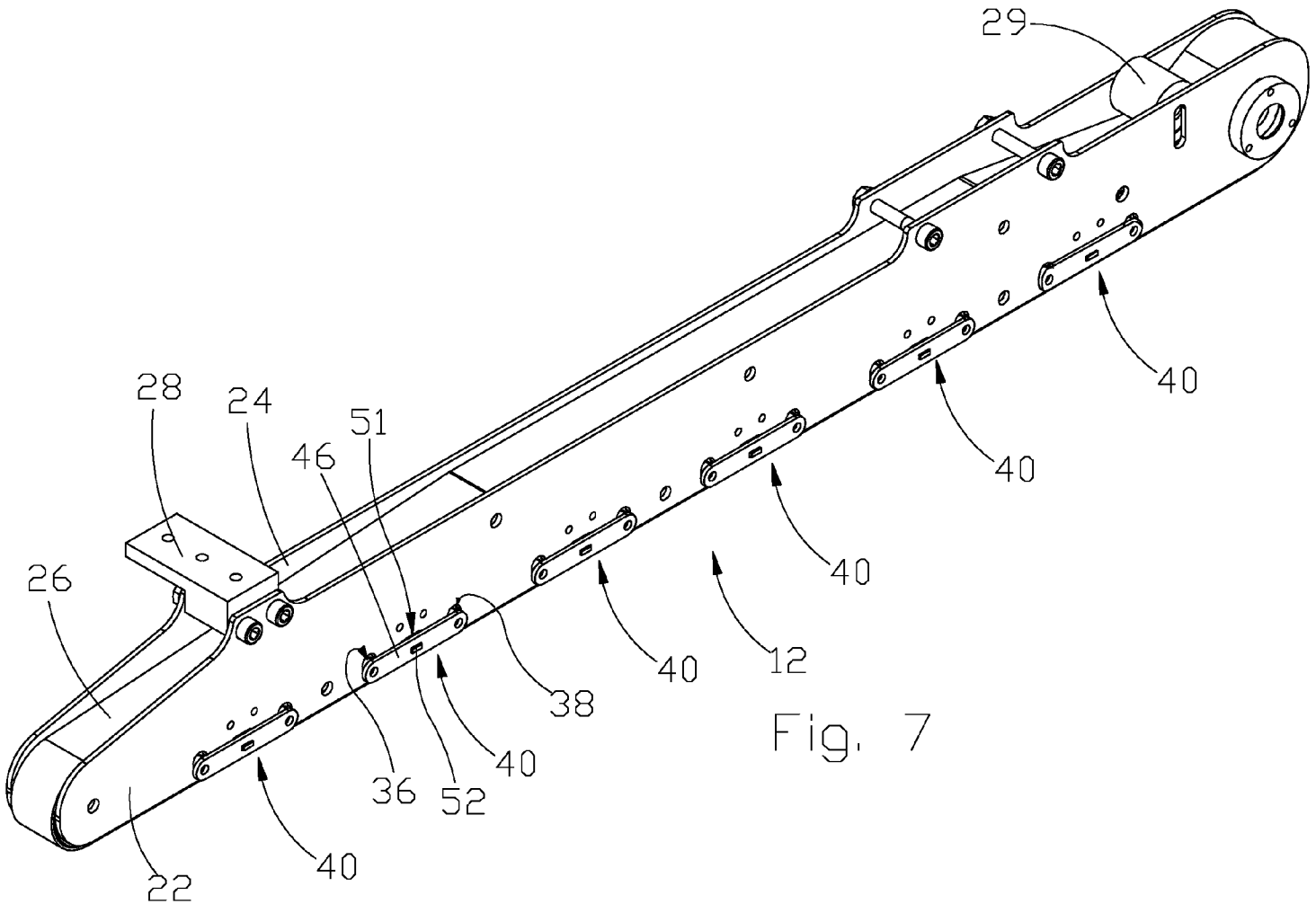
FIG. 7 is an axonometric view of the first conveyor belt.
Figure 8:
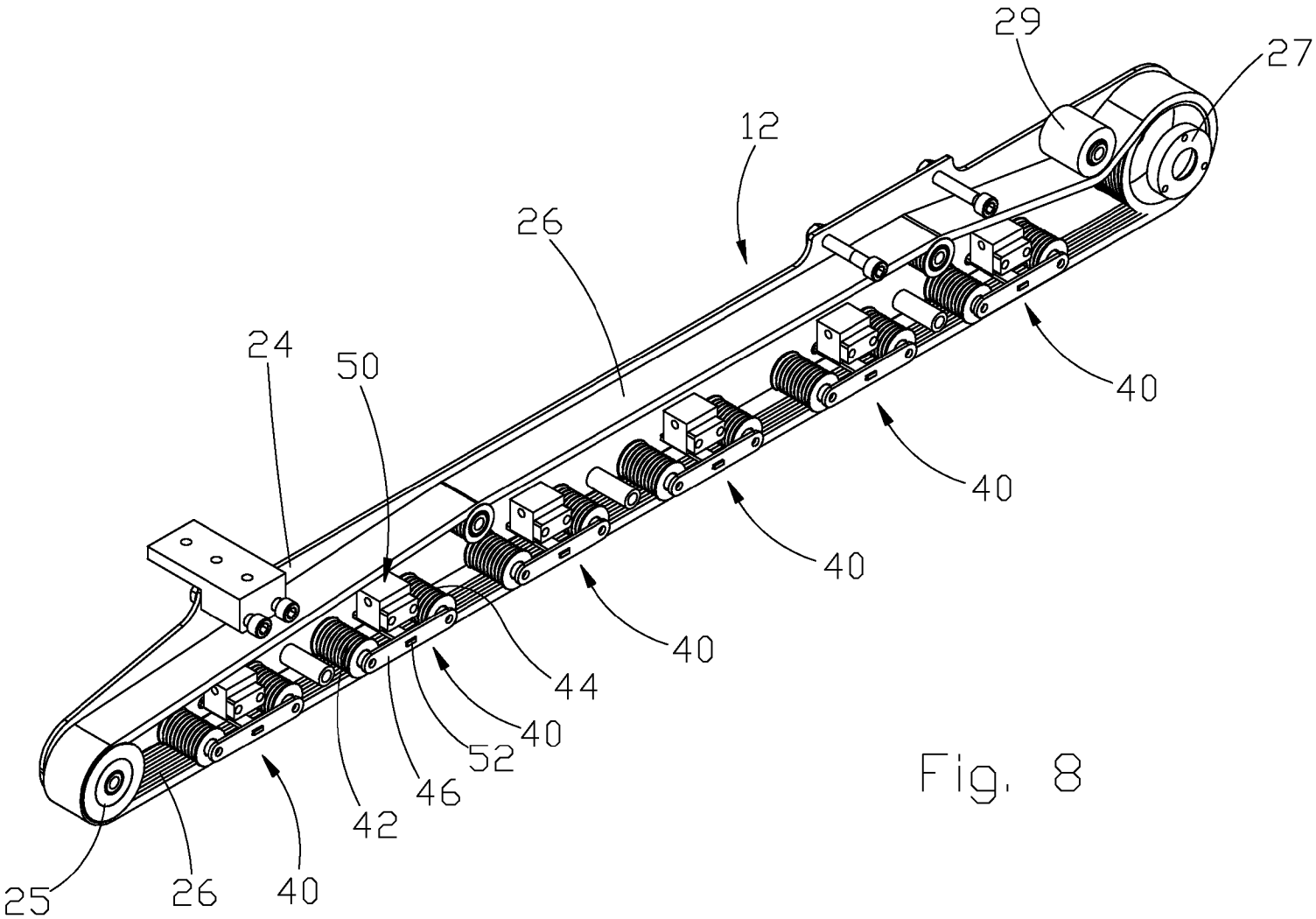
FIG. 8 is an axonometric view of the first conveyor belt without a covering element so that it is possible to see the inner mechanisms of the first conveyor belt.

As it appears from FIGS. 7, 8, the first conveying element 12 comprises a first side wall 22 and a second side wall 24. A first belt 26 is moved between said first side wall 22 and second side wall 24.

The first belt 26 is moved on two rollers 25, 27 which are fixed on the ends of the two side walls 22, 24 so as to rotate. The movement of the first belt 26 is controlled on the upper part by a first belt tightening pulley 29 and on the lower part by six carriages 40 which will be described below.

Figure 9:
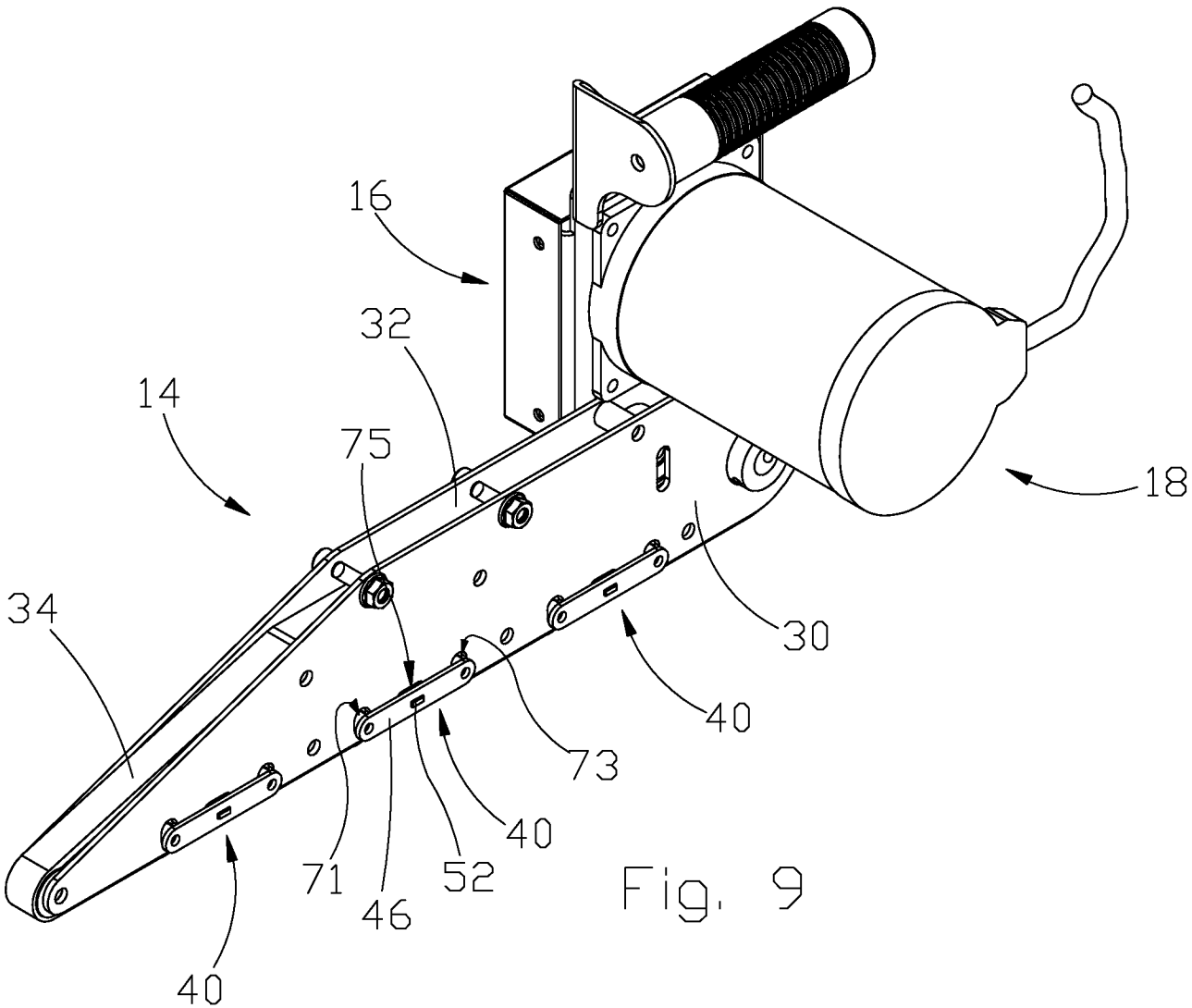
FIG. 9 is an axonometric view of the second conveyor belt.
Figure 10:
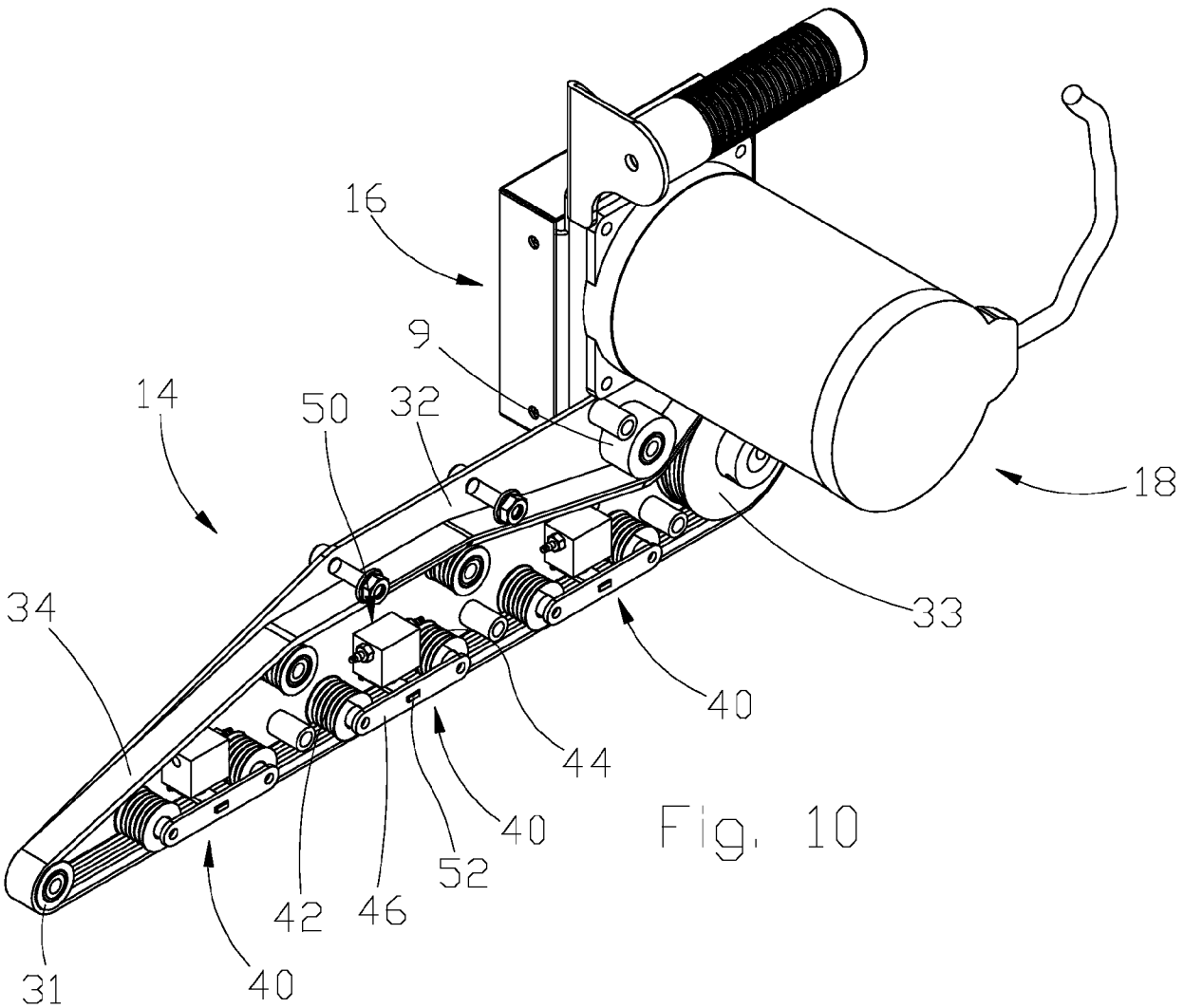
FIG. 10 is an axonometric view of the second conveyor belt without a covering element so that it is possible to see the inner mechanisms of the second conveyor belt.

Like the first conveying element 12, the second conveying element 14, represented in FIGS. 9, 10, comprises a third side wall 30 and a fourth side wall 32. A second belt 34 is moved between said third side wall 30 and fourth side wall 32.

The second belt 34 is moved on two rollers 31, 33 which are fixed on the ends of the two side walls 30, 32 so as to rotate. The movement of the second belt 34 is controlled on the upper part by a second belt tightening is pulley 9 and on the lower part by three carriages 40.

Figure 11:
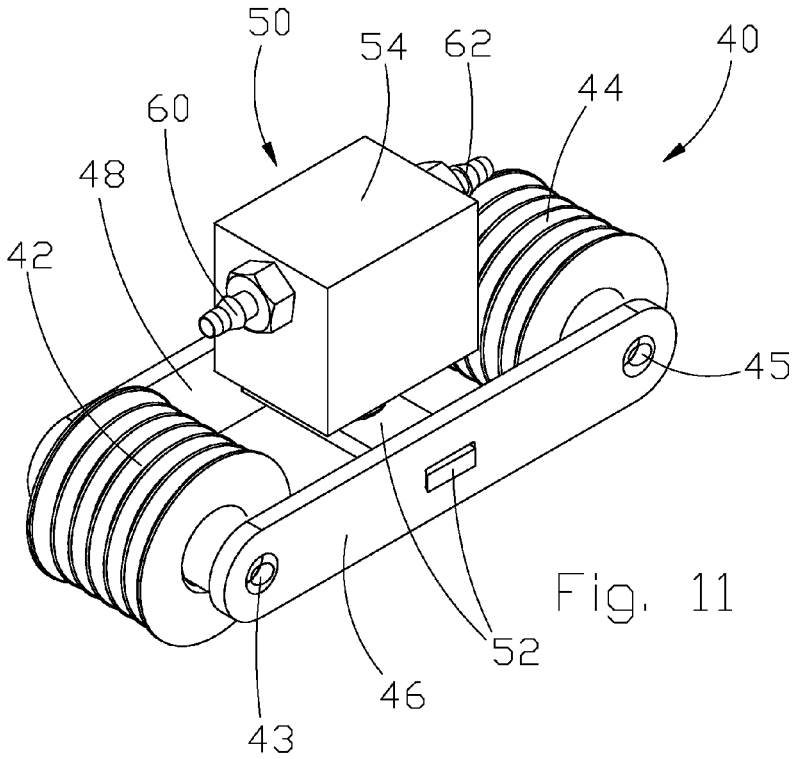
FIG. 11 is an axonometric view of a pressing carriage which is an element of the conveying device according to the invention.
Figure 12:
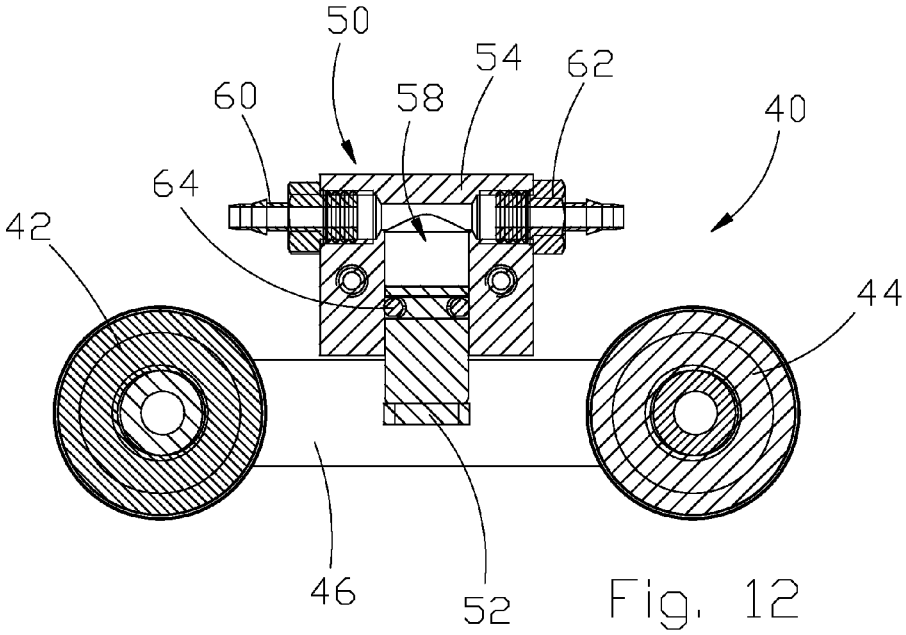
FIG. 12 is a side sectional view of the pressing carriage in FIG. 11.
Figure 13:
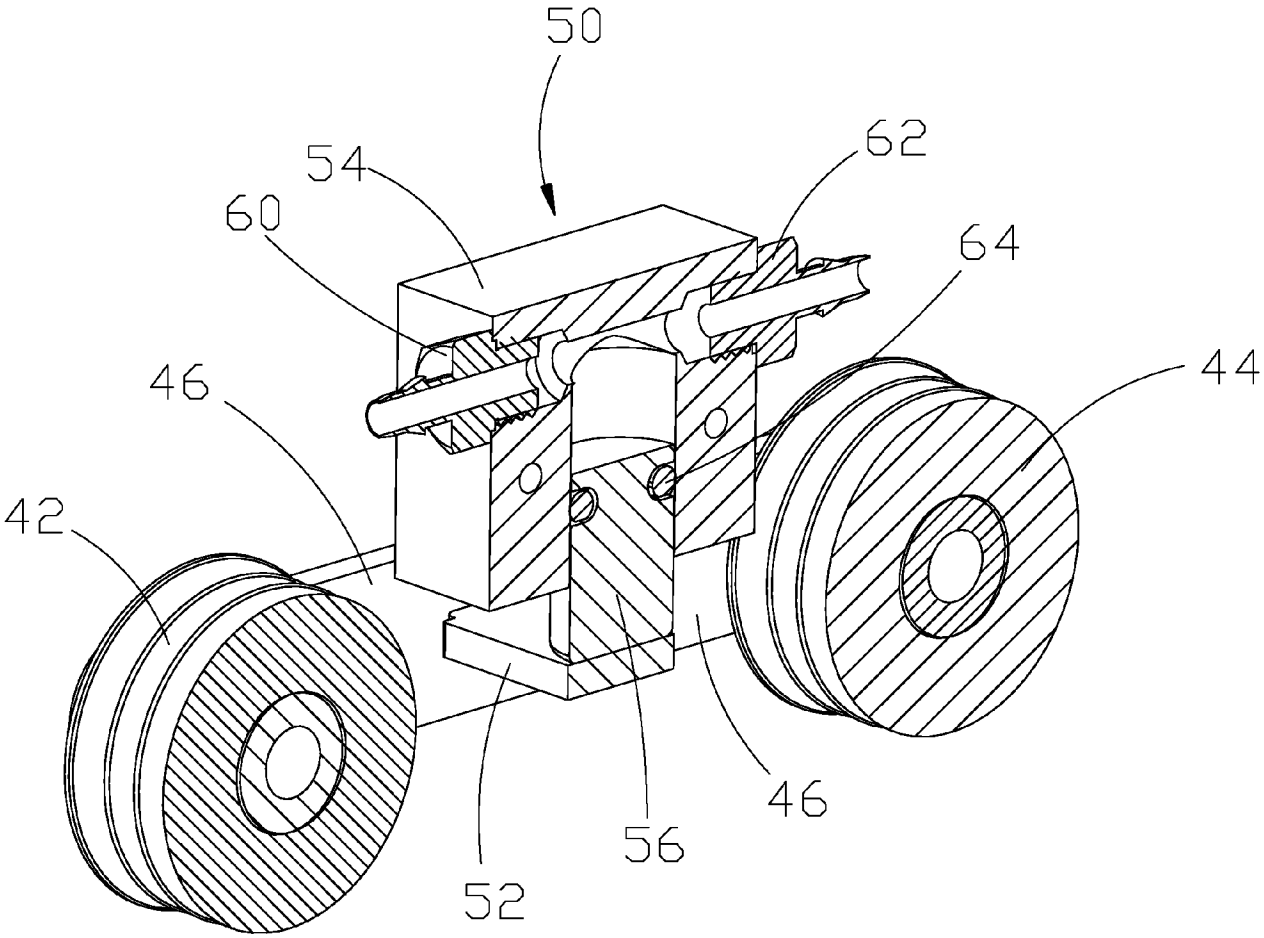
FIG. 13 is an axonometric view of the pressing carriage in FIG. 11.

As represented in FIGS. 11, 12, 13, each carriage 40 comprises a first roller 42 and a second roller 44 having respective pins 43, 45, connected on the one side with a first lamella 46 and on the other side with a second lamella 48. The first lamella 46 and the second lamella 48 are connected with each other and fixed in the middle by means of a plaque 52.

A cylinder 50 acts on the plaque 52. More precisely, the cylinder 50 comprises a body 54 in the inside of which a chamber 58 is obtained, along which a piston 56 translates vertically. The piston 56 is provided suitably with a packing ring 64.

The chamber 58 of the cylinder 50 is connected through two connectors 60, 62 with other analogous chambers and with a pneumatic regulation system.

The free end of the cylinder 56 acts on the plaque 52 and beats against said plaque without being constrained to it.

The connection of each carriage 40 with the first conveying element 12 and second conveying element 14 is carried out by placing side walls 22, 24, 30, 32 between the rollers 42, 44 and the lamellae 46, 48 and fixing the body 54 of each piston 50 on the side walls.

More specifically, as it appears from FIGS. 6, 7, six series of holes are obtained in the first side wall 22. Each of said series comprises three through-holes 36, 38, 51. Likewise, six series of holes, parallel to the others, are obtained in the second side wall 24. Each of these series comprises three through-holes of which only two are visible and are indicated with the reference numbers 37, 39 in FIG. 5.

The first pin 43 of the first roller 42 and the second pin 45 of the second roller 44 pass through the holes 36, 38, respectively. Out of the first side wall 22, said pins 43, 45 are connected with the first lamella 46 so as to rotate. The plaque 52 is fixed on the first lamella 46, as well and passes through the middle through-hole 51, obtained in the first side wall 22.

The same applies for the second side wall 24, as it appears from FIG. 5. the first pin 43 of the first roller 42 and the second pin 45 of the second roller 44 pass through the holes 39, 37, respectively. Out of the second side wall 24, said pins are connected with the second lamella 48 so as to rotate. The plaque 52 is fixed on the second lamella 48, as well and passes through the middle through-hole, obtained in the second side wall 24, not visible in FIG. 5.

The same structure and conformation is obtained for the second conveying element 14 in which three series of three holes are obtained both in the third side wall 30 and in the fourth side wall 32.

Each series of holes, both in the case of the first and second side wall 22, 24 of the first conveying element 12 and in the case of the third and fourth side wall 30, 32 of the second conveying element 14, comprises a first hole showing a vertical opening, a second hole showing a horizontal opening and a third hole showing a vertical opening.

Figure 14:
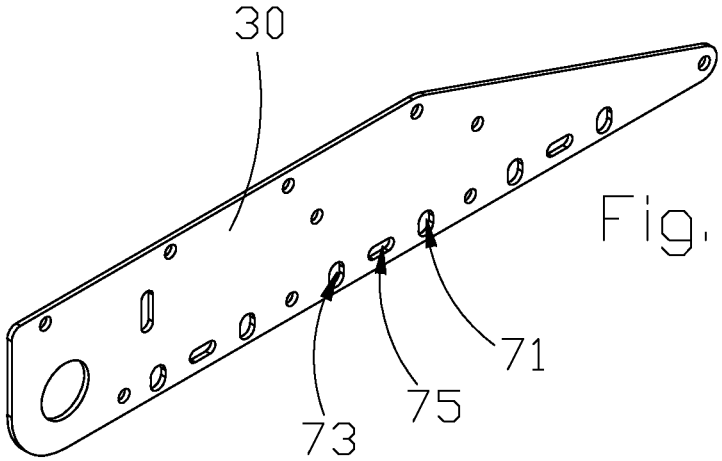
FIGS. 14, 15 are an axonometric view and a side view of a covering plate for the second conveyor belt, respectively.
Figure 15:
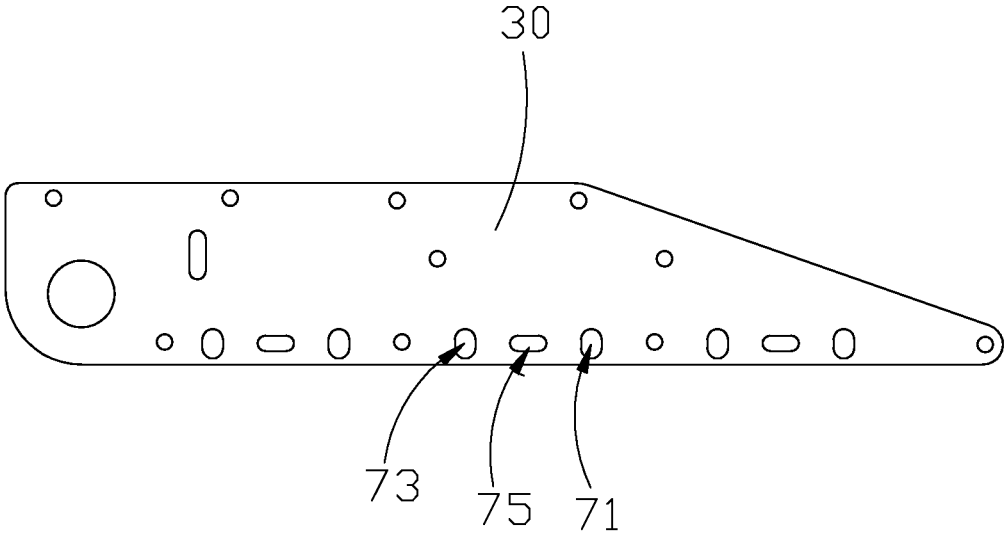
Figure 16:
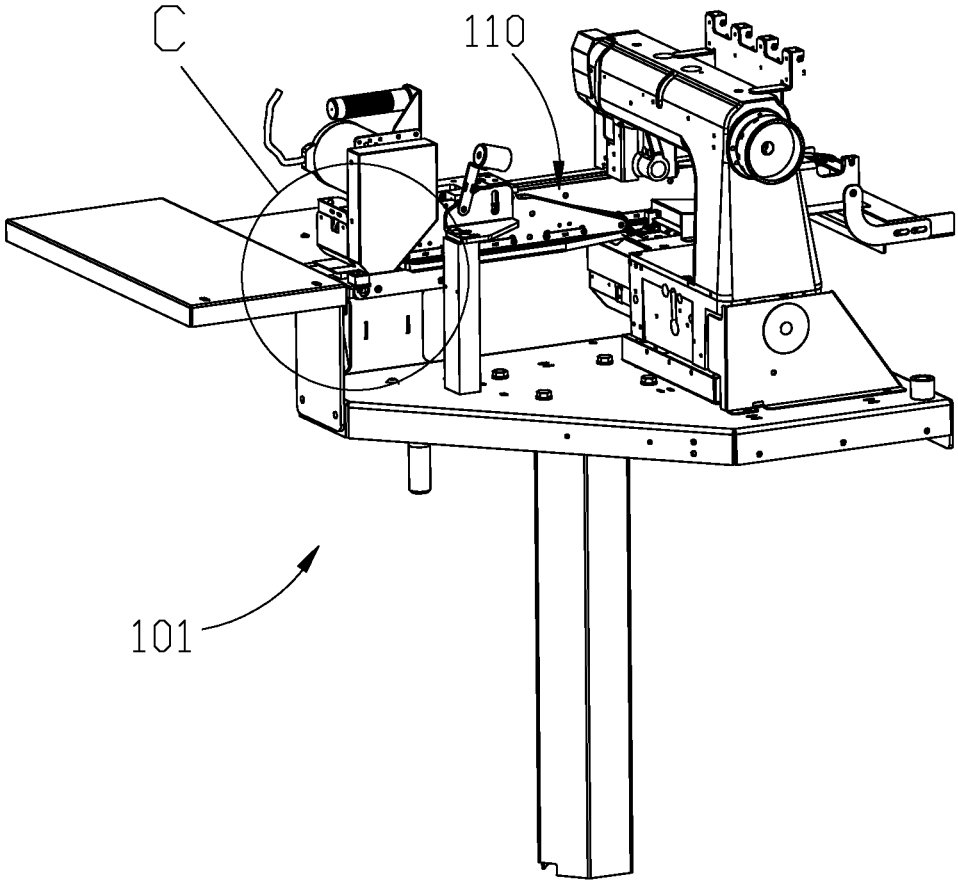
FIG. 16 is an axonometric top view of a sewing machine comprising a conveying device according to a variant of the invention.
Figure 17:
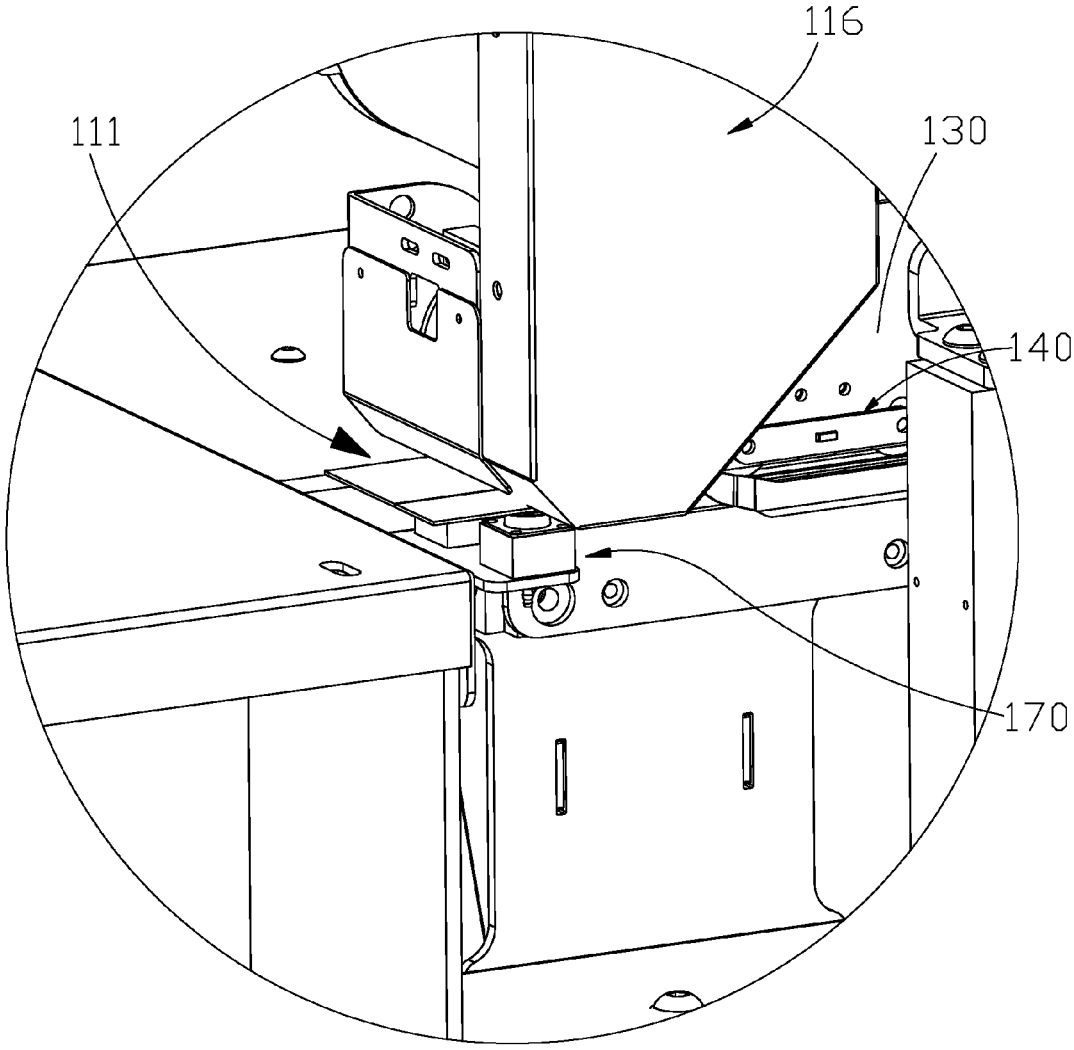
FIG. 17 shows a detail indicated with C in FIG. 16.
Figure 18:
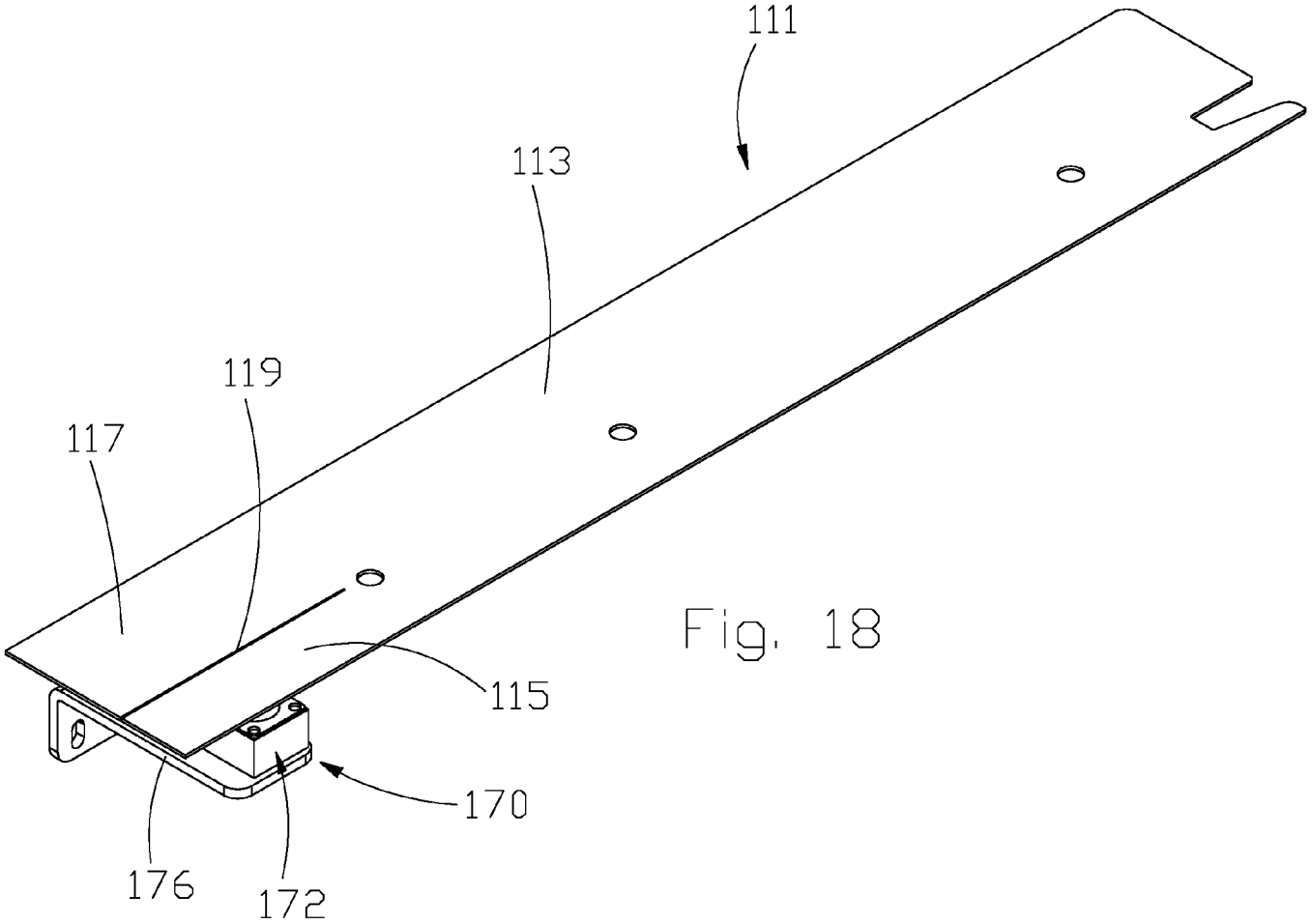
FIG. 18 is an axonometric top view of a base support of the conveyor belt in FIG. 16.
Figure 19:
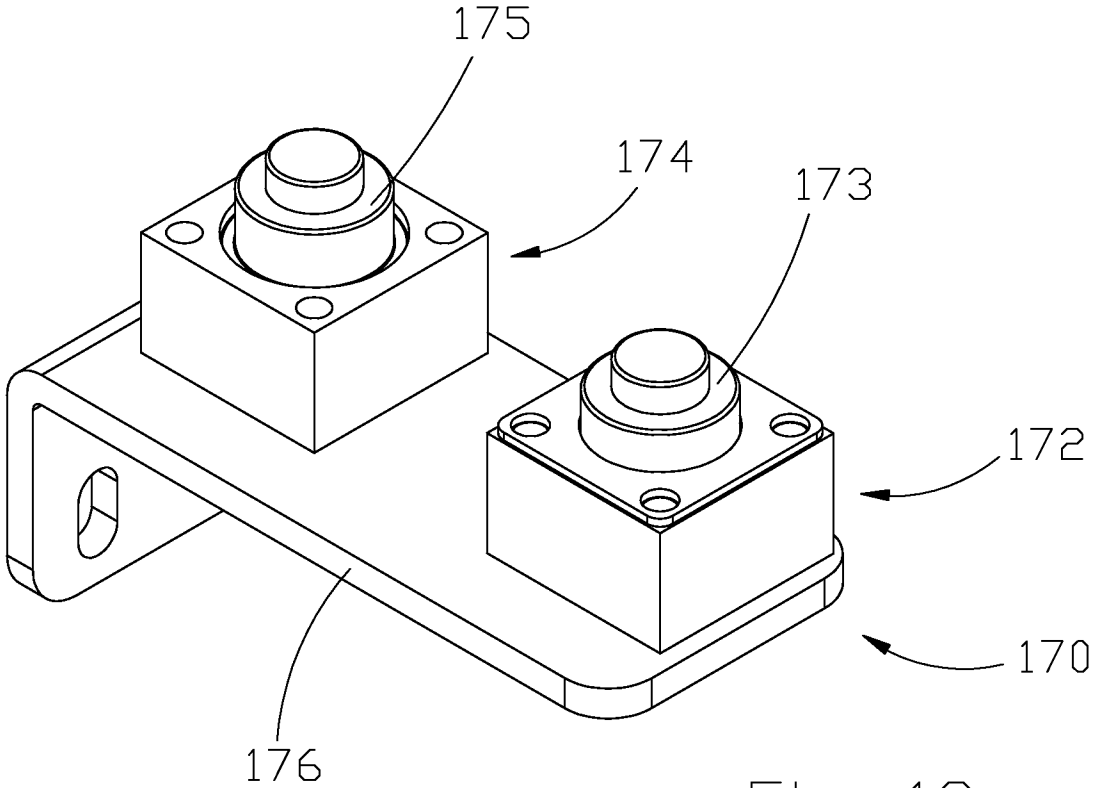
FIG. 19 is an axonometric top view of an element of the base support in FIG. 18.

FIGS. 14, 15 show the third side wall 30 in which the three series of holes are obtained. In particular, each series of holes comprises a first hole 71 showing a vertical opening, a second hole 75 showing a horizontal opening, and a third hole showing a vertical opening 73.

The dimensions of the holes obtained in the side walls are larger than the dimensions of pins 43, 45 and plaque 52 so that these elements can move in the inside of said holes. Consequently, the carriages 40 are not connected rigidly with the side walls 22, 24, 30, 32 but they are tilting since the carriages can not only translate vertically but also rotate relative to two perpendicular axes of a horizontal plane.

Accordingly, the cylinder 50, which is fixed on the side walls of each conveying element, acts with its piston 56 on the plaque 52 and adjusts the vertical position of the plaque without preventing the plaque from rotating. In this way, the rollers 42, 44 press the belt which in turn keeps a constant pressure on the cloth to be fed. At the same time, the rollers 42, 44 translate vertically and allow the belt to adapt to the little variations of conformation of the cloth.

The pressure of the carriages of each conveying element 12, 14 is kept constant since the chambers 58 of each cylinder 50 are connected in series through suitable conduits, not represented in the Figures, which are connected with the connectors 60, 62. Obviously, the ends of the series of conduits are suitably connected with a pneumatic system of regulation of the pressure.

According to a variant of the invention, represented in FIGS. 16, 17, 18, 19, a conveying device 110 comprises a base support 111, constrained to the base of a sewing machine 101. The conveying device 110 comprises a first conveying element and a second conveying element, which are not described since they are analogous to the elements of the conveying device 10 which has been described above.

The base support 111 comprises a plate 113 which is constrained to the base of the sewing machine but it has a free end which is free to tilt. The end of the plate 113 is subdivided into a first portion 115 and a second portion 117. A cut 119 separates said portions.

A pressing element 170 is arranged under the free end of the plate 113 and comprises a fixing bracket 176 for the fixing on the base of the sewing machine and two cylinders 172, 174. The respective pistons 173, 175 of said cylinders beat against the first portion 115 and the second portion 117 of the free end of the plate 113, respectively.

The cylinders 172, 174 are connected with each other and with a pressure regulation system in order to regulate the height and the possibilities of vertical translation of the free end of the plate 113.

The base support 111 is mounted on the conveying device 110 so that the free end of the plate 113 corresponds with the outermost rollers of the two conveying elements, in the entering part of the cloth in the conveying device. In this way, the regulation of the pressure on the cloth to be translated is actuated by the base support 111, namely, the two portions 115, 117 of the plate on which the two cylinders 172, 174 act. In this way, it is possible to remedy the lack of a pressure regulation system for the regulation of the pressure of the two belts in the front parts of the two conveying elements. The lack of said pressure regulation system is due to the presence of rollers which rotate without translating. These rollers are indicated with reference numbers 27, 33 in the conveying device 10.

According to another variant of the invention, in place of a pneumatic system for the control of the pressure with relative one or more pneumatic cylinders, a conveying device, analogous to the conveying device 10, described above, may have one or more cylinders in which a piston slides through the action of a spring or other equivalent elastic means, received in the inside of the cylinder. An end of the spring acts on the piston base so as to put the piston under pressure while the opposite end of the spring rests on an element of the cylinder which may vary its position through a mechanical system of regulation. In this way, as the position of the element of the cylinder varies, the extension of the spring varies and consequently, the pressure of the spring on the piston varies.

A technician of this field could conceive further modifications or variants which are to be intended as included in the scope of protection of the present invention. For instance, instead of utilizing a carriage comprising two rollers, it is possible to have a carriage comprising only one roller on which a piston acts to control the pressure of the belt on which the roller acts. In addition, instead of a pneumatic system for the regulation of the pressure, it is possible to utilize other types of fluids, more or less compressible.

The invention claimed is:

1. Conveying device (10; 110) to be mounted on a sewing machine (100; 101) comprising:

a plate (11; 111) to be constrained to a base of the sewing machine, a conveyor belt (26, 34) mounted on two rollers (25, 27, 31, 33) constrained to a supporting structure so as to rotate, the supporting structure being coupled with the sewing machine, so that the conveyor belt (26, 34) is adjacent to the plate (11; 111), motor means (18) for moving the conveyor belt connected with the conveyor belt (26, 34) so that a cloth arranged between the plate (11, 111) and the conveyor belt (26, 34) translates when the conveyor belt is put in motion, characterized in that it comprises at least one pressing element (42, 43, 44, 45, 46, 48, 52) actuated by a piston (56, 173, 175) which slides in the inside of a cylinder (50, 172, 174) which comprises elastic means for pressing the piston (56, 173, 175) and is constrained to the supporting structure of the conveyor belt (26, 34), said cylinder being connected with a pressure control system; said pressing element (42, 43, 44, 45, 46, 48, 52) being in touch with a sector of said plate (11, 111) and/or a sector of said belt (26, 34) so that the pressure control system adjusts the pressure acting on the cloth to be conveyed.

2. Conveying device (10; 110) according to claim 1, wherein said elastic means for pressing the piston (56, 173, 175) comprise a compressible fluid and wherein a chamber (58), in which the piston slides, is obtained in said cylinder (50, 172, 174), said chamber comprising said compressible fluid and being communicating with the pressure control system regulating the flow of compressible fluid in the chamber so that said pressure control system varies the quantity of said fluid in the inside of the chamber (58) and causes a variation of the pressure exerted on the sector of said plate (11, 111) and/or belt (26, 34) by the pressing element.

3. Conveying device (10; 110) according to claim 2, wherein the at least one pressing element comprises at least one roller (42, 44) with pins (43, 45) constrained to a carriage (46, 48, 52) so as to rotate, said carriage being actuated by a piston (56) of the cylinder (50), said roller (42, 44) acting on the conveyor belt (26, 34).

4. Conveying device (10; 110) according to claim 3, wherein at least one position limiting means (22, 24, 30, 32, 36, 38, 43, 45, 51, 52, 71, 73, 75) for limiting the position of the at least one roller comprises at least one side wall, said position limiting means being coupled with the supporting structure of the conveyor belt and being connected with the at least one roller (42, 44), so that the motion of the at least one roller (42, 44) is limited by said position limiting means.

5. Conveying device (10; 110) according to claim 4, wherein the carriage comprises at least one roller (42, 44) and the pins (43, 45) of said at least one roller are pivoted in at least a lamella (46, 48) on which a plaque (52) is fixed, the piston (56) of the cylinder (50) pressing said plaque (52).

6. Conveying device (10; 110) according to claim 5, wherein the at least one position limiting means for limiting the position of the at least one roller comprises at least one side wall (22, 24, 30, 32) fixed on the supporting structure of the conveyor belt (26, 34) and arranged parallel to the direction of action of the piston (56), at least one through-hole (36, 38, 51, 71, 73,75) in said side wall (22, 24, 30, 32), wherein at least one pin (43, 45) and/or the plaque (52) passes through said hole, the dimension of the at least one through-hole being larger than the passing section of the at least one pin (43, 45) and/or plaque (52) so that the at least one roller (42, 44) can shift in a limited space under the pressing action of the piston (56) and conveyor belt (26, 34).

7. Conveying device (10; 110) according to claim 5, wherein the carriage comprises a first roller (42) and a second roller (44) and the pins (43, 45) of said rollers are pivoted on a first lamella (46) on the one side and on a second lamella (48) on the other side, said first lamella (46) and said second lamella (48) being fixed on each other by means of the plaque (52).

8. Conveying device (10; 110) according to claim 6, wherein the carriage comprises a first roller (42) and a second roller (44) and the pins (43, 45) of said rollers are pivoted on a first lamella (46) on the one side and on a second lamella (48) on the other side, said first lamella (46) and said second lamella (48) being fixed on each other by means of the plaque (52).

9. Conveying device (10; 110) according to claim 8, wherein the position limiting means for limiting the position of the at least one roller comprise a first side wall (22, 30) fixed on a side of the supporting structure of the conveyor belt (26, 34), and a second side wall (24, 32) fixed on the opposite side of the supporting structure of the conveyor belt (26, 34), said first side wall (22, 30) and said second side wall (24, 32) being arranged parallel to the direction of action of the piston (56) and to the movement of the first roller (42) and second roller (44), at least a first series of through-holes comprising a first hole (36, 71), a second hole (51, 75) and a third hole (38, 73) being obtained in said first side wall (22, 30), at least a second series of through-holes comprising a first hole (37), a second hole and a third hole (39) being obtained in said second side wall (24, 32), the first series of holes and the second series of holes being arranged so as to correspond to each other, and wherein the pins (43) of the first roller (42) pass through the first hole (36, 71) of the first series of holes and through the first hole (37) of the second series of holes, the pins (45) of the second roller (44) pass through the third hole (38, 73) of the first series of holes and through the third hole (39) of the second series of holes, and the plaque (52) passes through the second hole (51, 75) of the first series of holes and through the second hole of the second series of holes, the dimension of the first hole, second hole and third hole of both the first series and the second series being larger than the passing section of the holes of the pins (43) of the first roller (42), the plaque (52) and the pins (45) of the second roller (44), respectively, so that the first roller (42) and the second roller (44) can move under the action of the piston (56) and in consequence of the pressure of the cloth on the belt (26, 34).

10. Conveying device (10; 110) according to claim 9, wherein the first lamella (46) and the second lamella (48) are coupled with the first pins (43), second pins (45) and plaque (52) out of the first side wall (22, 30) and second side wall (24, 32), and wherein the first roller (42) and the second roller (44) are positioned in the inside between the first side wall (22, 30) and the second side wall (24, 32).

11. Conveying device (10; 110) according to claim 10, wherein a plurality of carriages are connected to each other in series, and wherein the carriages are connected with the pressure control system to thereby obtain a constant pressure on the cloth.

12. Conveying device (110) according to claim 1, wherein an end (113, 115) of the plate is put under pressure by at least one pressing element actuated by at least one piston (173, 175) of a cylinder (172, 174) so that since said end of the plate corresponds to the entry for the cloth to be conveyed by the conveying device, the pressure on the cloth is controlled as from the entry of the same.

13. Conveying device (110) according to claim 12, wherein the end of the plate is divided by a cut (119) between a first sector (115) and a second sector (117), said first sector (115) being subjected to the action of a first pressing element, actuated by a first piston (173) of a first cylinder (172), said second sector (117) being subjected to the action of a second pressing element, actuated by a second piston (175) of a second cylinder (174), and a first conveyor belt acts on a cross sector of the plate, that corresponds to said first sector (115), corresponding pressing elements acting on said first conveyor belt and a second conveyor belt act on a cross sector of the plate corresponding to said second sector (117), and corresponding pressing elements acting on said second conveyor belt.

14. Conveying device (110) according to claim 3, wherein an end (113, 115) of the plate is put under pressure by at least a pressing element actuated by at least a piston (173, 175) of a cylinder (172, 174) so that since said end of the plate corresponds to the entry for the cloth to be conveyed by the conveying device, the pressure on the cloth is controlled as from the entry of the same.

15. Conveying device (110) according to claim 14, wherein the end of the plate is divided by a cut (119) between a first sector (115) and a second sector (117), said first sector (115) being subjected to the action of a first pressing element, actuated by a first piston (173) of a first cylinder (172), said second sector (117) being subjected to the action of a second pressing element, actuated by a second piston (175) of a second cylinder (174), and that a first conveyor belt acts on a cross sector of the plate, that corresponds to said first sector (115), corresponding pressing elements acting on said first conveyor belt and a second conveyor belt acts on a cross sector of the plate corresponding to said second sector (117), corresponding pressing elements acting on said second conveyor belt.

16. Conveying device (10; 110) according to claim 1, wherein said elastic means for pressing the piston (56, 173, 175) comprise a spring acting on the piston, and adjusting means for adjusting the extension of said spring, said adjusting means being connected with the pressure control system so that said pressure control system varies the extension of the spring and causes a variation of the pressure exerted on the sector of said plate (11, 111) and/or belt (26, 34) by the pressing element.

* * * * *